US007236429B2

(12) United States Patent
Yeh

(10) Patent No.: US 7,236,429 B2
(45) Date of Patent: Jun. 26, 2007

(54) TIMEPIECE SHOWING CURRENT LOCAL TIME IN MAIN CITIES AND COUNTRIES IN VARIOUS TIME ZONES

(76) Inventor: Neng-Chang Yeh, No. 9, Lane 207, Zihjhih St., Taichung City (TW)

( * ) Notice: Subject to any disclaimer, the term of this patent is extended or adjusted under 35 U.S.C. 154(b) by 225 days.

(21) Appl. No.: 11/131,402

(22) Filed: May 18, 2005

(65) Prior Publication Data

US 2006/0262649 A1 Nov. 23, 2006

(51) Int. Cl.
*G04B 19/22* (2006.01)

(52) U.S. Cl. ..... 368/21; 368/27

(58) Field of Classification Search ..... 368/21, 368/27

See application file for complete search history.

(56) References Cited

U.S. PATENT DOCUMENTS 2,395,643 A * 2/1946 Ramsay ..... 368/27
4,847,819 A * 7/1989 Hong ..... 368/21
4,945,521 A * 7/1990 Klaus ..... 368/21
5,745,440 A * 4/1998 Chen ..... 368/27
6,243,324 B1 * 6/2001 Teng ..... 368/21
6,597,635 B2 * 7/2003 Dalloz ..... 368/21

* cited by examiner

*Primary Examiner*—P. Austin Bradley
*Assistant Examiner*—Thanh S. Phan
(74) *Attorney, Agent, or Firm*—Rosenberg, Klein & Lee

(57) ABSTRACT

A timepiece includes first, second, and third clockwise rotating central shafts, a rotary dial joined to the first central shaft, a minute hand joined to the second central shaft, a second hand positioned around the rotary dial and joined to the third central shaft, a second ring, and a time zone ring; the rotary dial has twelve hour graduations, which are marked with respective numerals arranged in counterclockwise order; the second ring having sixty graduations thereon; the time zone ring is positioned around the second ring, and divided into twenty-four subsections; each subsection of the time zone ring has an indicating point on a middle portion of an inward edge, and is printed with names of main cities and countries in a time zone; thus, people can find out current local time in the main cities and countries with the timepiece.

7 Claims, 7 Drawing Sheets

TIMEPIECE SHOWING CURRENT LOCAL TIME IN MAIN CITIES AND COUNTRIES IN VARIOUS TIME ZONES

BACKGROUND OF THE INVENTION

1. Field of the Invention

The present invention relates to a timepiece, more particularly one, which shows current local time in main cities and countries in various time zones.

2. Brief Description of the Prior Art

Conventionally, timepieces have either a twelve-hour dial or a twenty-four hour one. The conventional timepieces can only tell the current local time in a certain time zone. Consequently, after the users travel to other cities/countries, which are in a different time zone, they have to adjust the timepieces such that the timepieces show the local time of the new cities/countries. Therefore, the conventional timepieces aren't convenient to use.

SUMMARY OF THE INVENTION

It is a main object of the invention to provide an improvement on a timepiece to overcome the above-mentioned problem. The timepiece includes first, second, and third clockwise rotating central shafts, a rotary dial joined to the first central shaft, a minute hand joined to the second central shaft, a second hand positioned around the rotary dial and joined to the third central shaft, a second ring, and a time zone ring. The rotary dial has twelve graduations, which are marked with respective numerals arranged in counterclockwise order; or alternatively, the rotary dial has twenty-four hour graduations. The second ring having sixty graduations thereon. The time zone ring is positioned around the second ring, and divided into twenty-four subsections, each of which has an indicating point on a middle portion of an inward edge, and is printed with names of main cities and countries in a time zone. Thus, people can find out current local time in the main cities and countries with the timepiece.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
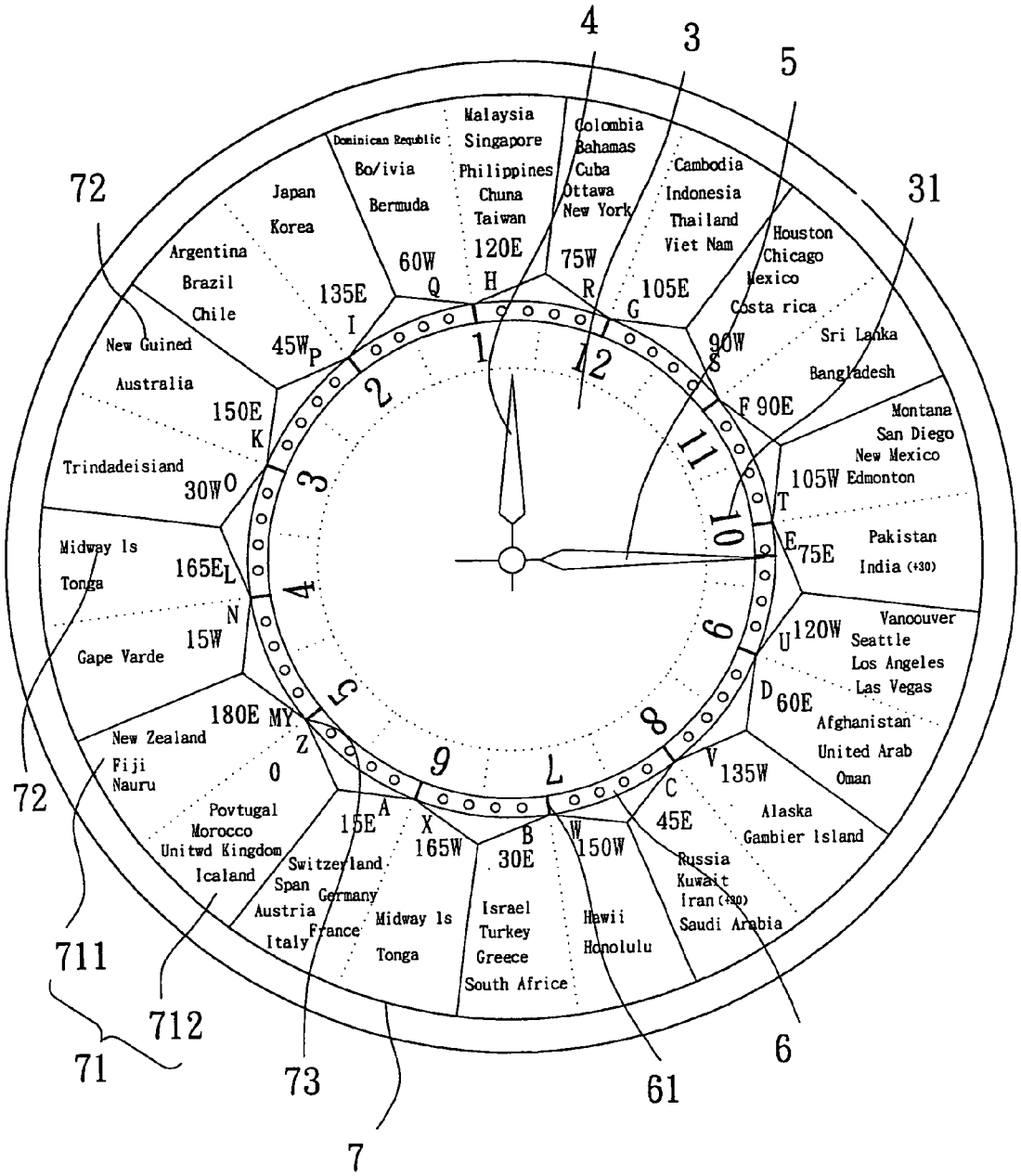
FIG. 1 is a front view of the first preferred embodiment.
Figure 2:
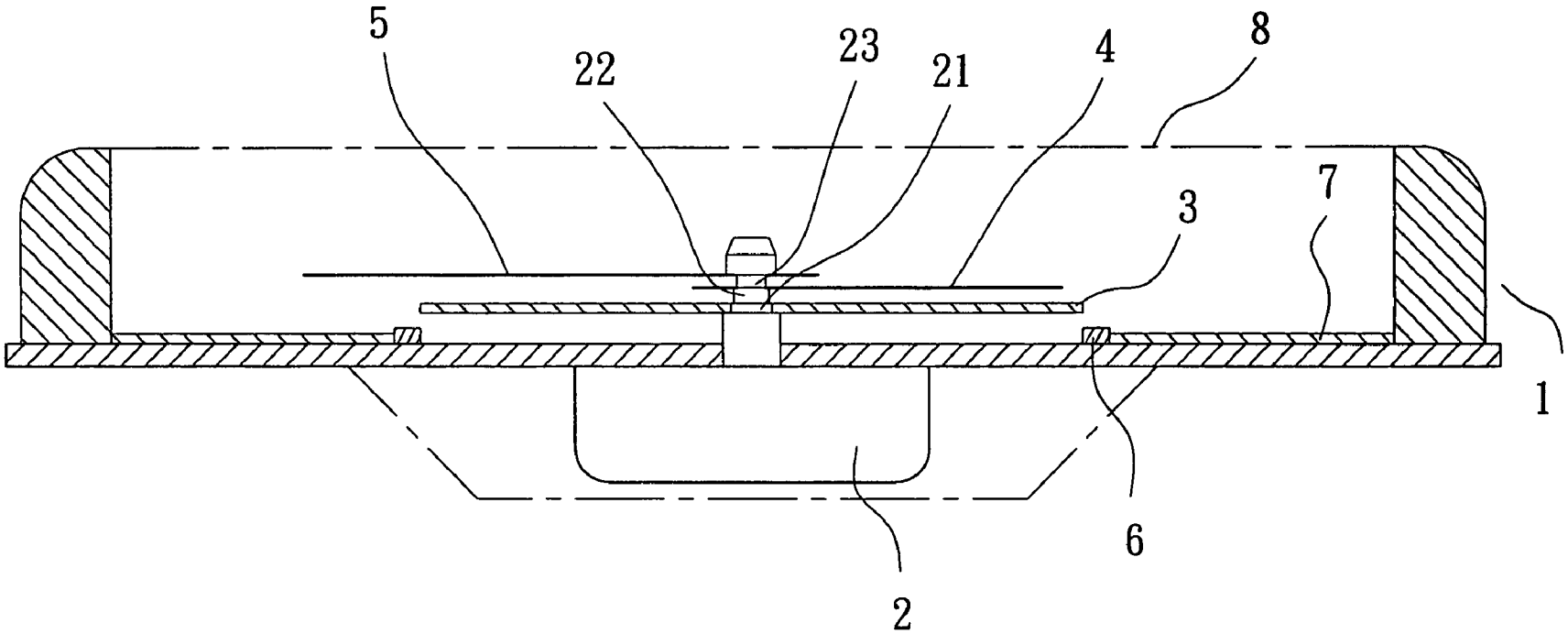
FIG. 2 is a side sectional view of the first preferred embodiment.

Referring to FIGS. 1 and 2, a first preferred embodiment of a timepiece includes a housing member 1, a mechanical member 2, a rotary dial 3, a minute hand 4, a second hand 5, a second ring 6, a time zone ring 7, and a glass cover 8.

The mechanical member 2 is held in the housing member 1, and includes a first central shaft 21, a second central shaft 22, and a third central shaft 23, all of which central shafts 21, 22, and 23 rotate in the clockwise direction. The glass cover 8 is secured over the housing member 2.

The rotary dial 3, the minute hand 4, and the second hand 5 are joined to the first central shaft 21, the second central shaft 22, and the third central shaft 23 respectively.

The rotary dial 3 is used for showing the current hour, and is a twelve-hour dial, having twelve graduations thereon; the rotary dial 3 has twelve hour-graduations 31 thereon. The hour graduations 31 are marked with numerals 1 through 12, which are arranged in a counterclockwise order.

The second ring 6 has graduations 61 thereon, which are in one-second increments, and it is positioned around the rotary dial 3, and used together with the second hand 5 for telling the current second.

The time zone ring 7 is positioned around the second ring 6, and divided into twelve areas 71 of same shape and equal size, each of which has an indicating point 73 on a middle portion of an inward edge thereof. Furthermore, each of the twelve areas 71 is divided into left and right portions 712 and 711. The left portions 712 of the areas 71 are provided for time zones on West Longitude; names of main cities and countries in various time zones on West Longitude are printed on corresponding left portions 712 of the areas 71 of the time zone ring 7. The right portions 711 of the areas 71 are provided for time zones on East Longitude; names of main cities and countries in various time zones on East Longitude are printed on corresponding right portions 711 of the areas 71 of the time zone ring 7; in each area 71, the East Longitude time zone on the right portion 711 of the area 71 is twelve hours apart from the West Longitude time zone on the left portion 712 of the area 71. Or alternatively, the left portions 712 of the areas 71 can be used for time zones on East Longitude, and the right portions 711 for time zones on West Longitude.

Thus, people can find out current local time in the main cities and countries in the time zones with the help of the present timepiece.

Figure 3:
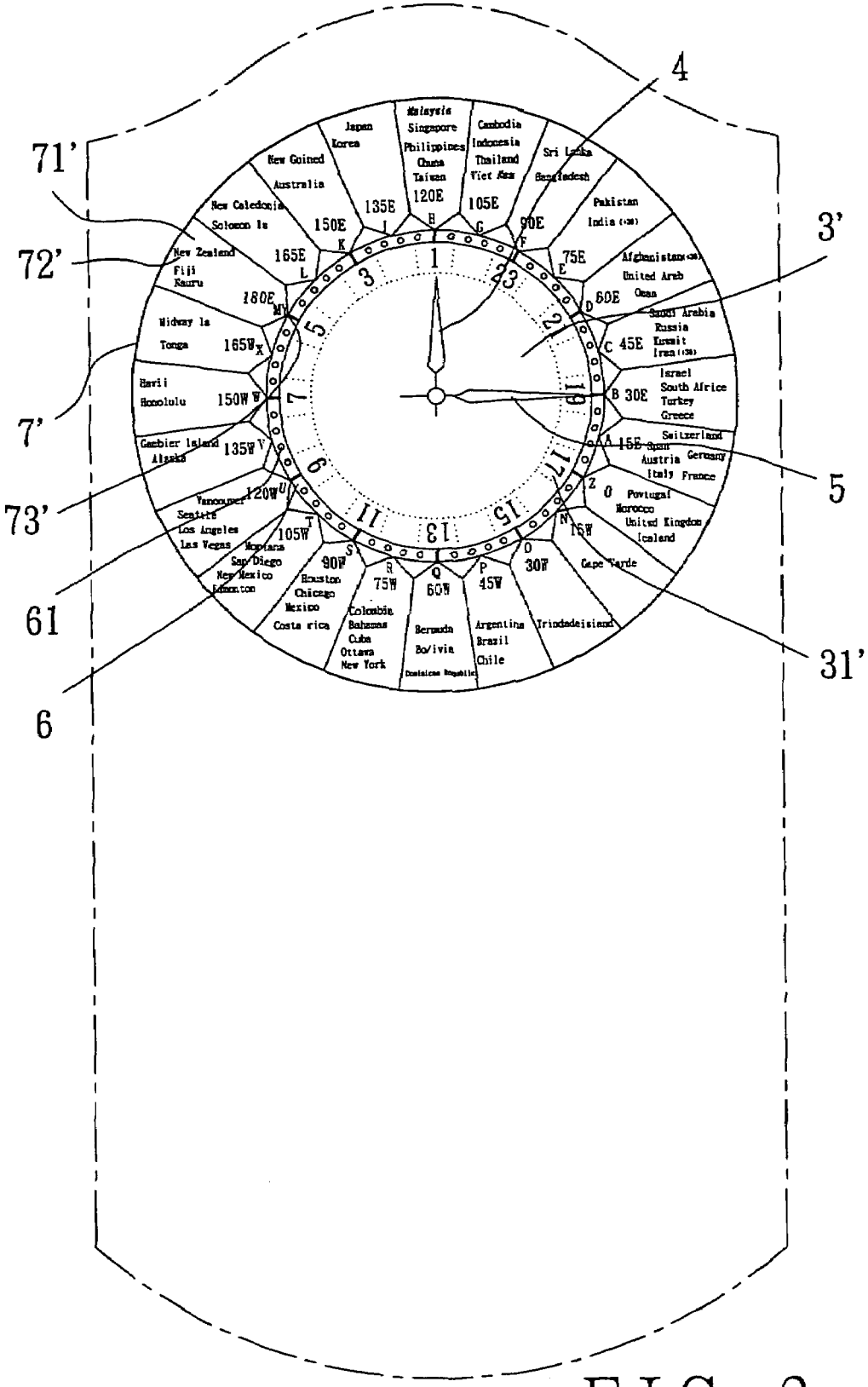
FIG. 3 is a front view of the second preferred embodiment.
Figure 4:
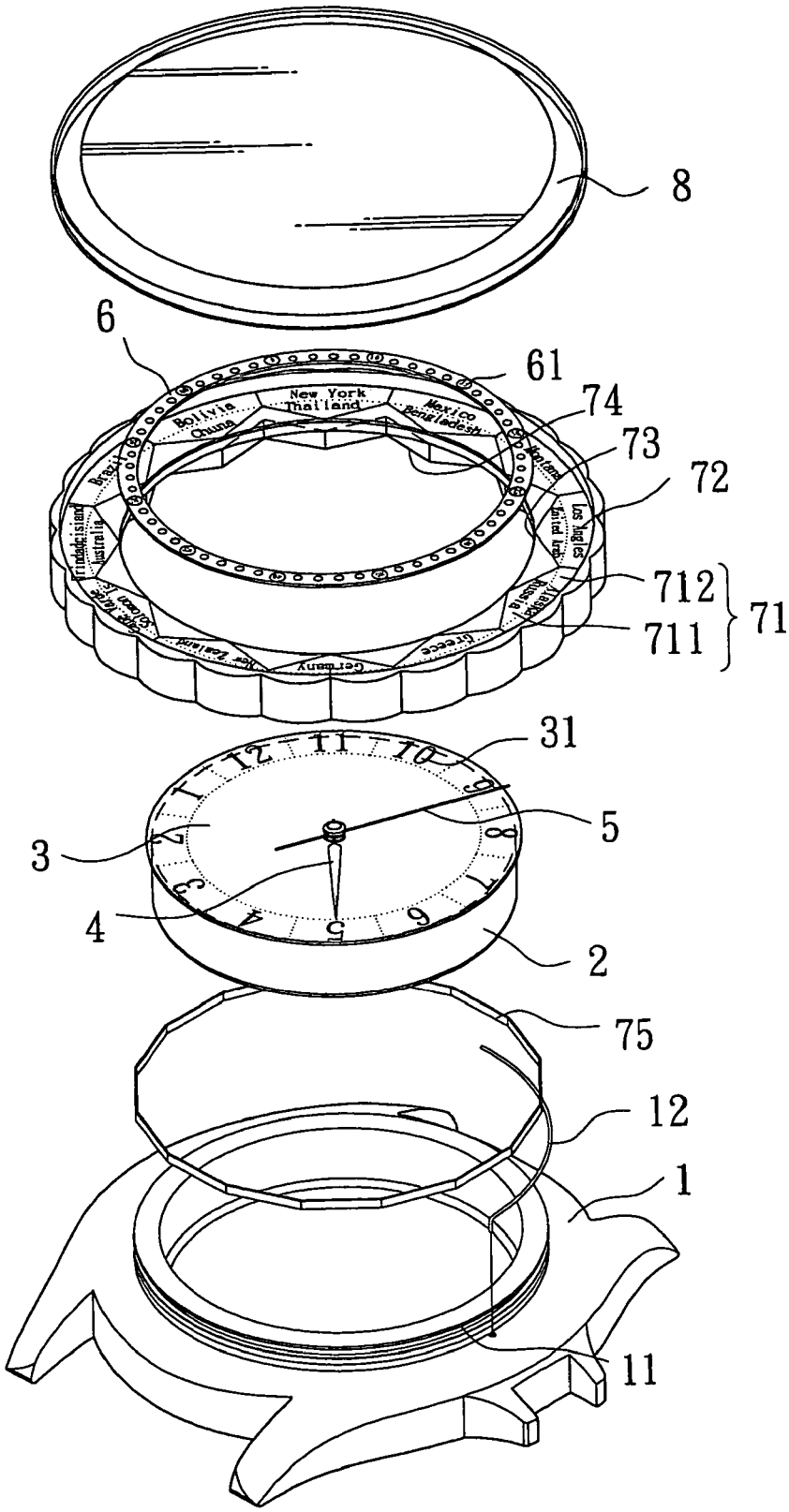
FIG. 4 is an exploded perspective view of the third preferred embodiment.
Figure 5:
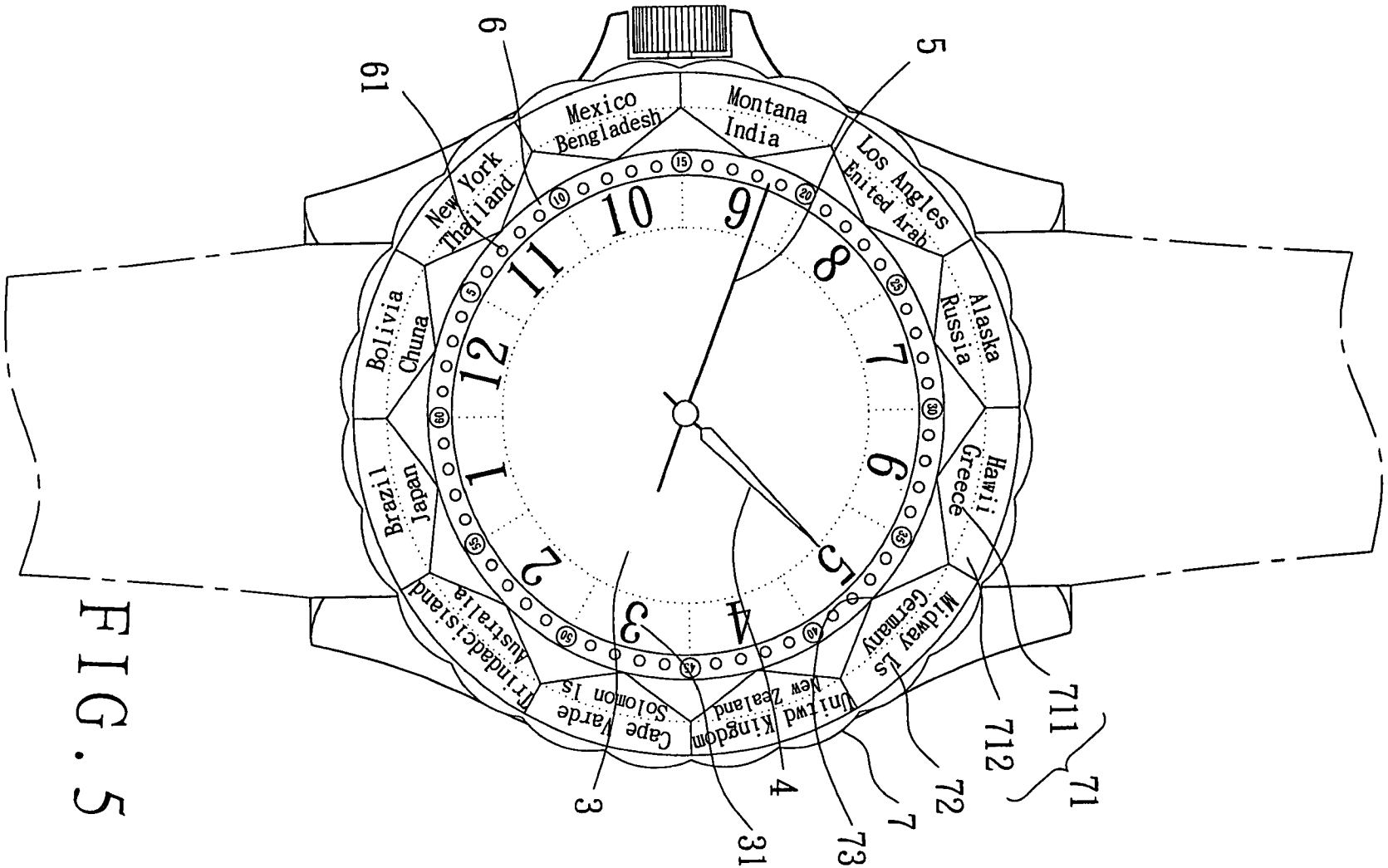
FIG. 5 is a front view of the third preferred embodiment.
Figure 6:
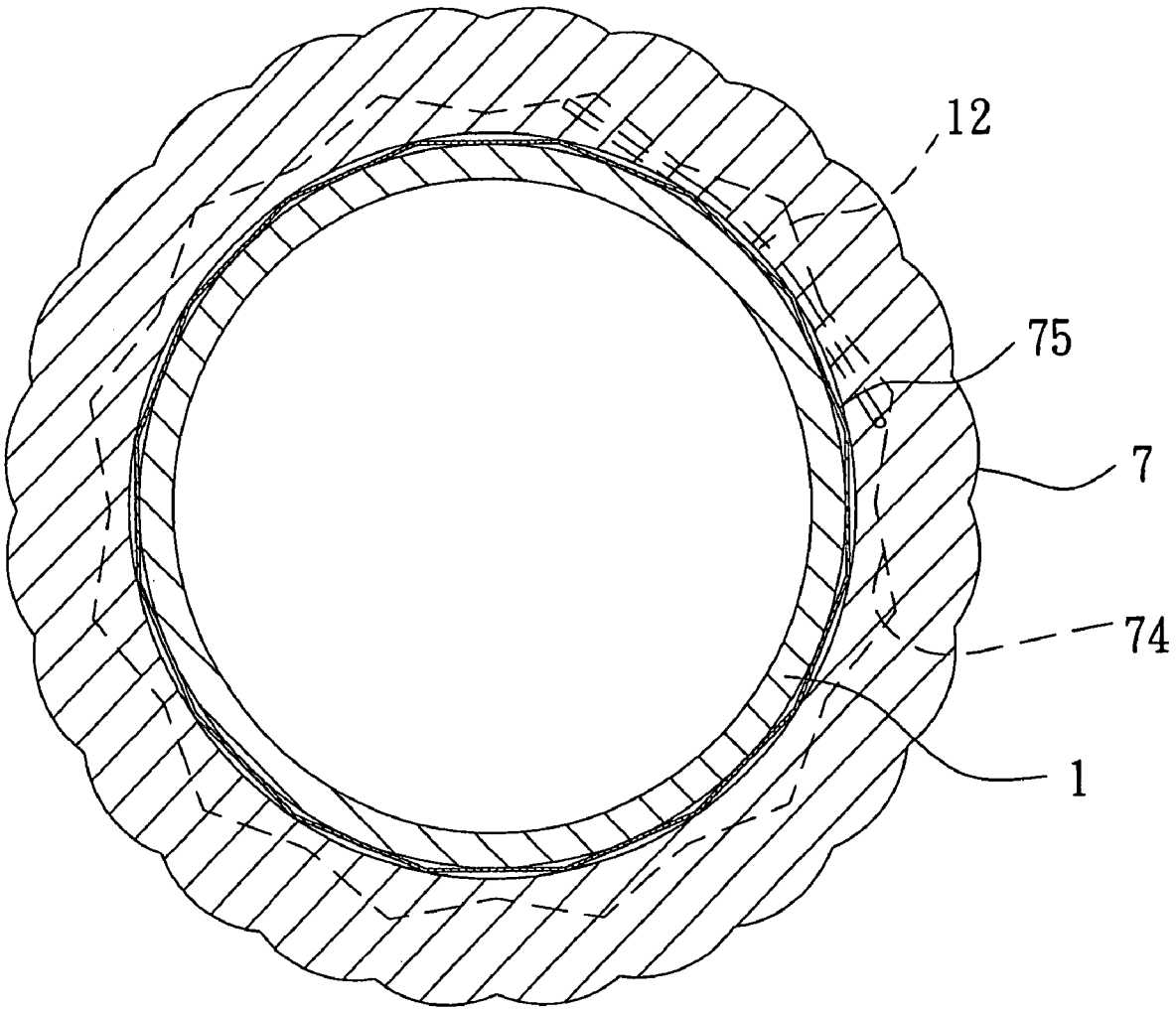
FIG. 6 is a front sectional view the third embodiment.
Figure 7:
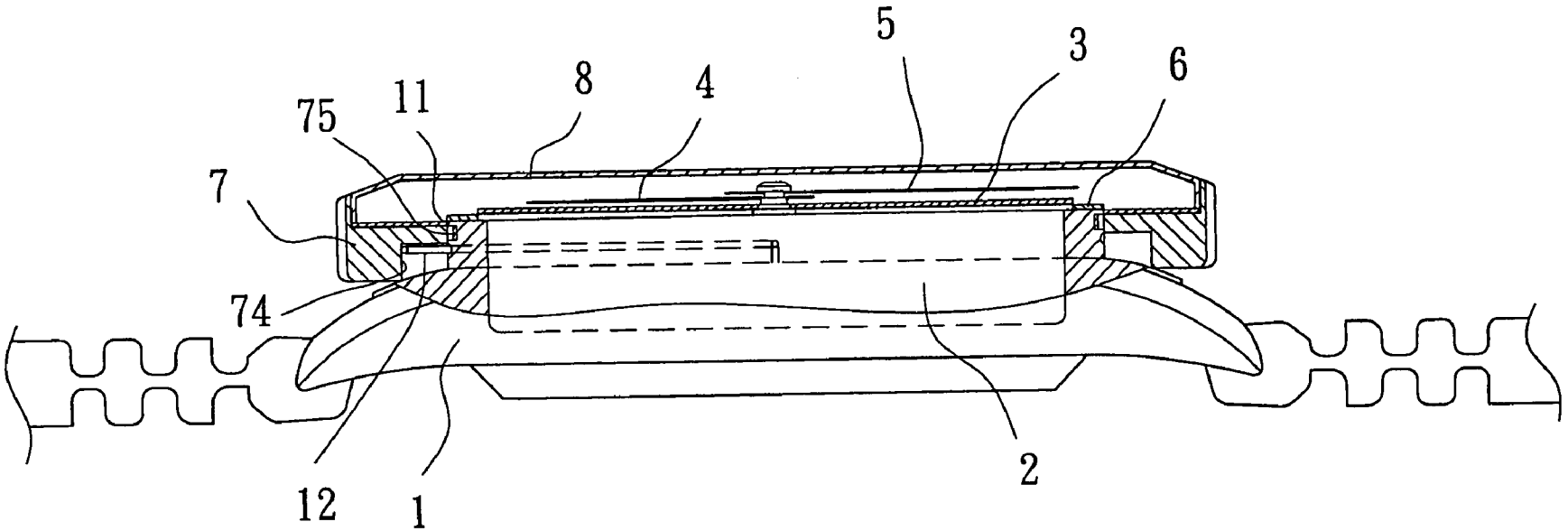
FIG. 7 is a side sectional view of the third preferred embodiment.

Referring to FIG. 3, a second preferred embodiment of a timepiece is provided. The second preferred embodiment basically has the same structure and works in the same way as the first preferred embodiment, but it includes a rotary dial 3', and a time zone ring 7' instead of the rotary dial 3, and the time zone ring 7. The rotary dial 3' is a 24-hour dial, having twenty-four graduations thereon; the rotary dial 3' has twenty-four graduations 31' arranged in a counterclockwise order thereon, and it takes twenty-four hours for the rotary dial 3' to complete a revolution. The time zone ring 7' is divided into twenty-four areas 71' of the same shape and equal size; each of the twenty-four areas 71' has an indicating point 73' on a middle portion of an inward edge thereof; names of main cities and countries in each time zone are printed on a respective one of the areas 71'; time zones on every two exactly opposite ones of the areas 71' are twelve hours apart.

Referring to FIGS. 4 to 7, a third preferred embodiment of a timepiece includes a housing member 1, a mechanical member 2, a rotary dial 3, a minute hand 4, a second hand 5, a second ring 6, a time zone ring 7, and a glass cover 8.

The mechanical member 2 is secured in the housing member 1, and includes a first central shaft 21, a second central shaft 22, and a third central shaft 23, all of which central shafts 21, 22, and 23 rotate in the clockwise direction. The glass cover 8 is secured over the housing member 2.

The rotary dial 3, the minute hand 4, and the second hand 5 are joined to the first central shaft 21, the second central shaft 22, and the third central shaft 23 respectively. The rotary dial 3 is used for showing the current hour, and is a 12-hour one; the rotary dial 3 has twelve graduations 31 thereon. The twelve graduations 31 are marked with numerals 1 through 12, which are arranged in a counterclockwise order. The second ring 6 has graduations 61 thereon, which are in one-second increments, and it is positioned around the rotary dial 3, and used together with the second hand 5 for telling the current second.

The time zone ring 7 is positioned around the second ring 6, and divided into twelve areas 71 of same shape and equal size, each of which has an indicating point 73 on a middle portion of an inward edge thereof. Each of the twelve areas 71 is divided into a first portion 711, and a second portion 712, which are next to an inward edge, and an outward edge of the time zone ring 7 respectively. The first portions 711 of the areas 71 are provided for time zones on East Longitude; names of main cities and countries in various time zones on East Longitude are printed on corresponding first portions 711 of the areas 71. The second portions 712 of the areas 71 are provided for time zones on West Longitude; names of main cities and countries in various time zones on West Longitude are printed on corresponding second portions 712 of the areas 71; in each area 71, the East Longitude time zone on the first portion 711 thereof is twelve hours apart from the West Longitude time zone on the second portion 712. Or alternatively, the second portions 712 of the areas 71 can be used for time zones on East Longitude, and the first portions 711 for time zones on West Longitude.

The housing member 1 has an annular fitting groove 11 on an annular wall portion thereof. And, an elastic polygonal ring 75 is secured on an inner side of the time zone ring 7 and fitted in the annular fitting groove 11 of the housing member 1; thus, the time zone ring 7 is connected with, and angularly displaceable relative to the housing member 1. Therefore, the user is allowed to adjust the orientation of the time zone ring 7 so as to relocate the area 71 printed with the name of his/her city (country) to the uppermost portion of the timepiece. Thus, people can find out current local time in the main cities and countries in the time zones with the help of the present timepiece.

Furthermore, an engaging element 12 is secured next to an outer side of the annular wall portion of the housing member 1, and an inner side of the time zone ring 7 is formed with a saw tooth shape on a lower portion, having equidistantly spaced saw tooth shaped portions, and a receiving gap 74 between every two adjacent ones of the saw tooth shaped portions. The time zone ring 7 is connected to the housing member 1 such that two ends of the engaging element 12 are held in the receiving gaps 74 to engage the saw tooth shaped inner side of the time zone ring 7 so as to prevent the time zone ring 7 from being accidentally turned. Therefore, the time zone ring 7 will be firmly held in position after the user adjusts the orientation of the time zone ring 7 so as to relocate the area 71 printed with the name of his/her city (country) to the uppermost portion of the timepiece.

Or alternatively, the third embodiment can be equipped with a rotary dial 3', and a time zone ring 7', as shown in FIG. 3. The rotary dial 3' is a 24-hour one; the rotary dial 3' has twenty-four graduations 31' arranged in a counterclockwise order thereon, and it takes twenty-four hours for the rotary dial 3' to complete a revolution. The time zone ring 7' is divided into twenty-four areas 71' of the same shape and equal size; each of the twenty-four areas 71' has an indicating point 73' on a middle portion of an inward edge thereof; names of main cities and countries in each time zone are printed on a respective one of the areas 71'; time zones on every two exactly opposite ones of the areas 71' are twelve hours apart.

From the above description, it can be easily seen that people can easily find out the current local time in the main cities and countries, of which the names are shown on the time zone ring, with the help of the present timepiece.

What is claimed is:

1. A timepiece showing current local time in main cities and countries in various time zones, comprising a housing member;

a mechanical member held in the housing member; the mechanical member including a first central shaft, a second central shaft, and a third central shaft, all rotating in a clockwise direction;

a glass cover secured over the housing member;

a rotary dial joined to the first central shaft of the mechanical member; the rotary dial having a plurality of hour graduations thereon; the hour graduations being marked with respective numerals arranged in counterclockwise order;

a minute hand joined to the second central shaft of the mechanical member;

a second hand positioned around the rotary dial and joined to the third central shaft of the mechanical member;

a second ring having sixty graduations thereon, which are in one-second increments, for showing a current second together with the second hand; and a time zone ring positioned around the second ring and connected to the housing member; the time zone ring being divided into twenty-four subsections; each of the twenty-four subsections having an indicating point on a middle portion of an inward edge thereof; each of the twenty-four subsections being printed with names of main cities and countries in a corresponding time zone;

whereby people can find out current local time in the main cities and countries, of which the names are printed on the time zone ring.

2. The timepiece as claimed in claim 1, wherein the rotary dial is a twelve-hour dial, having twelve graduations thereon, and the time zone ring is divided into twelve areas, and each area is divided into first and second subsections; first and second subsections of each of the twelve areas of the time zone ring being respectively provided for use with a time zone on West Longitude, and a time zone on East Longitude, both of which time zones are twelve hours apart.

3. The timepiece as claimed in claim 1, wherein the rotary dial is a twenty-four-hour dial, having twenty-four graduations thereon, and every two exactly opposite ones of the twenty-four subsections of the time zone ring are provided for use with respective time zones, which are twelve hours apart.

4. The timepiece as claimed in claim 1, wherein the housing member has an annular fitting groove on an annular wall portion thereof, and an elastic polygonal ring is secured on an inner side of the time zone ring and fitted in the annular fitting groove of the housing member such that the time zone ring is angularly displaceable relative to the housing member.

5. The timepiece as claimed in claim 4, wherein an engaging element is secured on the housing member, and an inner side of the time zone ring is formed with a saw tooth shape, having equidistantly spaced saw tooth shaped portions, and a receiving gap between every two adjacent ones of the saw tooth shaped portions; two ends of the engaging element being held in corresponding receiving gaps to engage the saw tooth shaped inner side of the time zone ring so as to prevent the time zone ring from being accidentally turned after the time zone ring is angularly displaced to relocate names of selected cities and countries to an uppermost end of the timepiece.

6. The timepiece as claimed in claim 1, wherein the time zone ring is angularly displaceable relative to the housing member for relocating names of selected cities and countries to an uppermost end of the timepiece, and an engaging element is secured on the housing member, and an inner side of the time zone ring is formed with a saw tooth shape, having equidistantly spaced saw tooth shaped portions, and a receiving gap between every two adjacent ones of the saw tooth shaped portions; two ends of the engaging element being held in corresponding receiving gaps to engage the saw tooth shaped inner side of the time zone ring so as to prevent the time zone ring from being accidentally turned after angular displacement.

7. The timepiece as claimed in claim 1, wherein the rotary dial is a twelve-hour dial, having twelve graduations thereon, and the time zone ring is divided into twelve areas, and each of the twelve areas is divided into a first subsection near to an outward edge of the time zone ring, and a second subsection near to an inward edge of the time zone ring; first and second subsections of each of the twelve areas of the time zone ring being respectively provided for use with a time zone on West Longitude, and a time zone on East Longitude, both of which time zones are twelve hours apart.

* * * * *